US005234103A

United States Patent [19]

Schuster

[11] Patent Number: 5,234,103

[45] Date of Patent: Aug. 10, 1993

[54] ENCLOSED BASKET-STYLE CARRIER

[75] Inventor: Richard L. Schuster, Monroe, La.

[73] Assignee: Riverwood International Corporation, Atlanta, Ga.

[21] Appl. No.: 933,435

[22] Filed: Aug. 21, 1992

[51] Int. Cl.[5] ..... B65D 71/00

[52] U.S. Cl. ..... 206/158; 206/184

[58] Field of Search ..... 206/151-153, 206/155, 158, 166-169, 183, 185, 188, 427, 184

[56] References Cited

U.S. PATENT DOCUMENTS

| | | | |
|---|---|---|---|
| Re. 29,063 | 12/1976 | Graser | 206/141 |
| 1,799,657 | 4/1931 | Tinsley | 206/167 |
| 2,609,137 | 9/1952 | Toensmeier | 206/166 |
| 2,760,677 | 8/1956 | Arneson | 220/115 |
| 2,842,288 | 7/1958 | Dunning et al. | 220/113 |
| 3,156,358 | 11/1964 | Randrup | 206/153 |
| 3,198,381 | 8/1965 | Gioia | 220/115 |
| 3,339,726 | 9/1967 | Moore | 206/155 |
| 3,722,945 | 3/1973 | Wood | 206/153 |
| 3,760,978 | 9/1973 | Stone | 220/115 |
| 4,397,416 | 8/1983 | Bishop | 229/52 BC |

FOREIGN PATENT DOCUMENTS

| | | | |
|---|---|---|---|
| 0111290 | 7/1968 | Denmark | 206/153 |

*Primary Examiner*—Jimmy G. Foster

[57] ABSTRACT

A basket-style carrier having a top panel for enclosing the carrier. The top panel comprises flaps foldably connected to the side panels which contain openings through which a top portion of articles packaged in the carrier extend. The flaps also include at least one fold line extending parallel to the side panels, allowing the flaps to be folded over so that their free ends extend to and contact the center partition of the carrier. This biases the top panel flap edges against the center partition and an edge of the opening against the underside of flanges or other transversely extending projections of the articles packaged in the carrier. The handle in a center partition may be designed as a three-ply reinforced handle.

31 Claims, 8 Drawing Sheets

ENCLOSED BASKET-STYLE CARRIER

FIELD OF THE INVENTION

This invention relates to a basket-style carrier for carrying articles such as beverage bottles. More particularly, it relates to a basket-style carrier having top panel flaps for enclosing the contents of the carrier.

BACKGROUND OF THE INVENTION

Carriers of various types and designs have long been used to package beverage containers. Both bottles and cans have been packaged in wrap-around carriers, which are formed by folding a carton blank around an aligned group of containers and mechanically fastening the ends of the blank together. Such a carrier normally does not have end panels, or at least not full end panels, and does not fully enclose its contents. Another design is the sleeve-type carrier which is formed by folding and gluing a blank to form an open-ended sleeve, loading the containers into the sleeve and then closing and securing the end panels. Except for handle openings and heel cutouts through which the bottom portions of the containers extend to assist in holding them in place, containers packaged in this manner are essentially fully enclosed.

Currently there is greater emphasis in the beer industry in marketing unpasteurized beer, which must be maintained unexposed to light in order for the product to remain aseptic. Beer of this type is conventionally sold in bottles, which are darkened to prevent spoilage of the contents. Dark bottles are not enough, however, to ensure the quality of the product. It is also required that the carrier block the entry of light into the package. Although the sleeve-type carrier is capable of providing this function it is not perceived within the industry as a carrier suitable for packaging a premium product.

The basket-style carrier, which has a separate cell for each bottle and a center partition containing a handle opening, has long been associated with the packaging of premium products. It has excellent strength, can easily be lifted and carried and protects the bottles against contact with adjacent bottles in the carrier. Its normally open design does not, however, suit it to carrying bottles of unpasteurized beer since there is no protection against light. Although attempts have been made in the past to provide enclosed basket-style carriers, prior art designs have not been satisfactory for a number of reasons. Some have been too expensive due to excessive material requirements, some too unwieldy to carry due to poor handle design, and some have top panel designs which are either difficult for the consumer to open or do not consistently remain closed during normal lifting and handling.

In view of the need for an improved basket-style carrier capable of fully enclosing its contents, it is an object of the invention to provide such a carrier which overcomes the drawbacks of prior art carriers.

BRIEF SUMMARY OF THE INVENTION

The invention provides a carrier for packaging articles which have a transversely extending projection in the top portion thereof, such as the cap or integral rim or flange of a bottle. The carrier comprises two side panels connected to two end panels and to a bottom panel. A center partition extends from one end panel to the other end and contains a handle opening therein. A top panel flap is connected to each side panel. Each top panel flap has an unconnected end edge remote from the side panel to which the top panel is connected, a fold line extending substantially parallel to the center partition and an opening adjacent the fold line for receiving a top portion of an article contained in the carrier. The opening has a locking edge spaced from the fold line in the direction of the center partition, the locking edge being located so as to engage the outwardly extending projection of an article on the underside thereof.

The essentially curved configuration of the flexible top panel flaps and the fact that the unconnected edge of each top panel flap is in contact with the center partition, tends to bias the flap up against the underside of the article projection to tighten the latching of the top panel flap in place. The top panel flaps are thus able to securely cover the top of the carton while allowing the top panel to be easily and readily moved out of the way by a consumer in order to expose the contents of the package.

In a preferred arrangement each top panel flap has a second fold line substantially parallel to the fold line mentioned above which is spaced from the first fold line in a direction toward its associated side panel. The area between the fold lines is substantially flat and parallel to the bottom panel, enabling this portion of the top panel flap to contact the top flat portion of an article top, such as a bottle cap, to assist in tightly holding the article in place. The end panels and the top panel flaps are formed in such a way that the handle opening is visible to a user, while at the same time being of a design that completely encloses the articles. In a modified arrangement, the handle is reinforced with an extra ply folded down from a handle opening.

The carrier preferably includes at least one transverse partition extending from each side of the center partition toward the side panels to divide the interior of the carrier into article-receiving cells.

As will be seen, the carrier can be formed from a blank of minimum size, preferably of paperboard, making it economical to use, can be easily and readily lifted and carried, and encloses its contents to enable bottles containing light-sensitive beverages to be safely packaged. These and other features and aspects of the invention will be readily ascertained from the detailed description of the preferred embodiments described below.

DETAILED DESCRIPTION OF THE PREFERRED EMBODIMENTS

Figure 1:
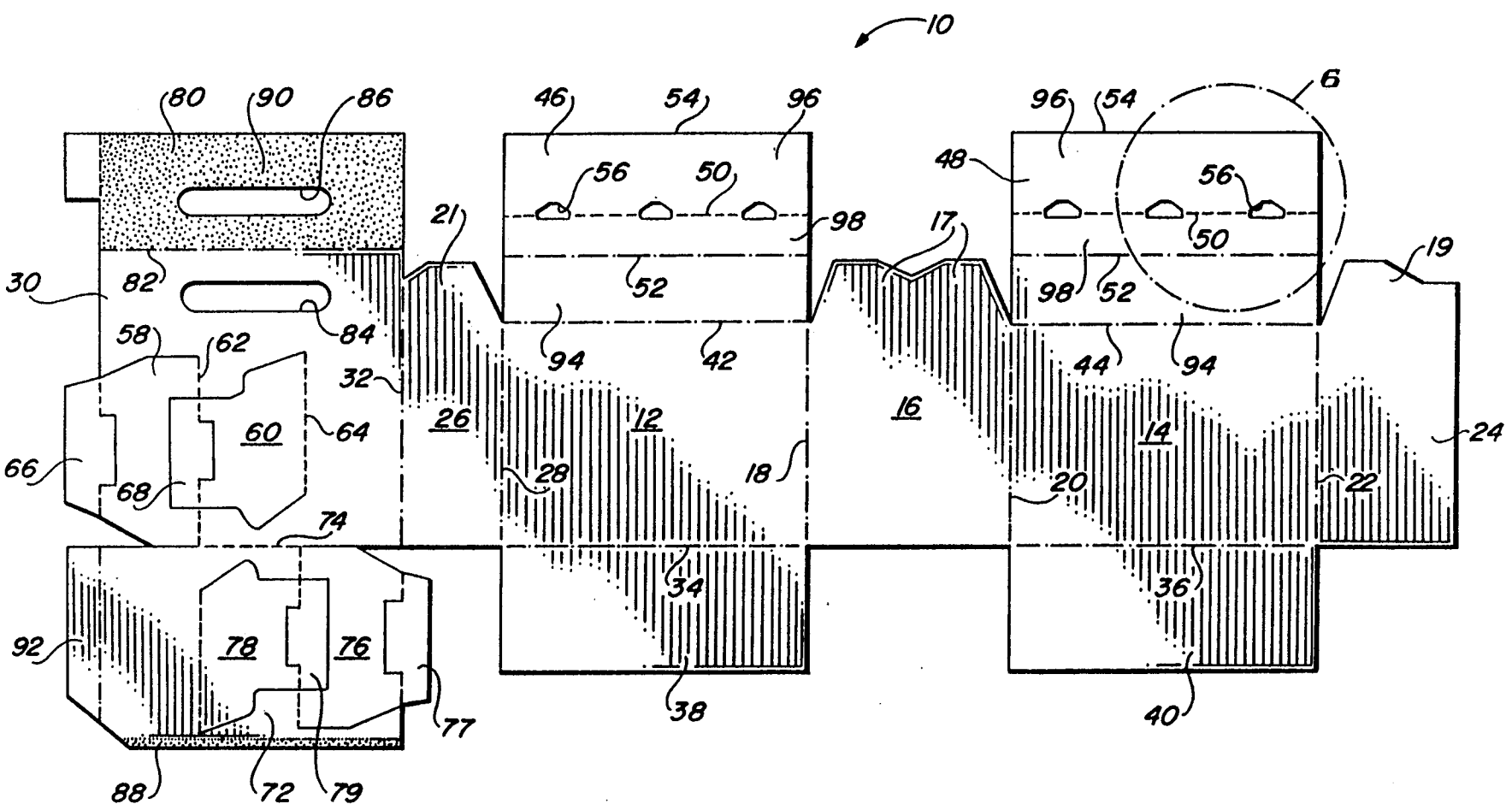
FIG. 1 is plan view of a blank for forming the carrier of the invention.

Referring to FIG. 1, a blank 10 capable of being formed into the carrier of the invention is of generally rectangular shape and comprises two side panel sections 12 and 14 spaced apart by an end panel section 16. The end panel section 16 is connected to the side panel section 12 by fold line 18 and to the side panel section 14 by fold line 20. Connected to the opposite side of side panel section 14 by fold line 22 is end panel flap 24. Another end panel flap 26 is connected to the opposite side of side panel 12 by fold line 28. The end panel flaps are designed to be adhered together to form a full end panel, with the end panel flap 24 being slightly wider than the end panel flap 26 to provide extra width for a glue flap. The end panel section 16 includes extensions 17 and the end panel flaps 24 and 26 each include extensions 19 and 21, respectively, for the purpose of covering the ends of the top panel of the carrier, as described in more detail below. The particular shape of the extensions is also important in allowing the handle opening of the carrier to be seen, also as described in more detail below. In addition, a center partition 30 is connected to the end panel flap 26 by fold line 32. The fold lines 18, 20, 22, 28 and 32 are substantially parallel to each other.

Connected to the side panel sections 12 and 14 along fold lines 34 and 36 are bottom panel sections 38 and 40, respectively. Connected to the opposite edges of the side panel sections 12 and 14 along fold lines 42 and 44 are top panel flaps 46 and 48, respectively. Each top panel flap includes spaced fold lines 50 and 52, which are substantially parallel to the fold lines 42 and 44, and each terminates in an end edge 54 remote from, and parallel to, the connecting fold lines 42 and 44. Each fold line 50 is interrupted by openings 56 for receiving the top portions of bottles or other articles to be packaged in a carrier formed from the blank.

The center partition 30 includes transverse partition flaps 58 and 60 which are connected to the partition 30 by fold lines 62 and 64, respectively. The flaps 58 and 60 include foldable glue flaps 66 and 68, respectively, for adhering the transverse partition flaps to a side panel of the carrier. A center partition flap 72, which is connected to the center partition 30 along fold line 74 so as to fold back upon the center partition 30, is also provided with transverse partition flaps 76 and 78. These flaps are similar to the transverse partition flaps 58 and 60, but face in the opposite direction to allow their glue flaps to be adhered to the other side panel. A handle flap 80 is connected to the center partition 30 along fold line 82 at the end of the center partition opposite the fold line 74. The center partition 30 and the handle flap 80 contain handle openings 84 and 86, respectively, adapted to be aligned in a carrier formed from the blank.

The blank is substantially rectangular in shape and is formed from a flexible material, preferably paperboard. The ends of the top panel flaps 54 are aligned with the end of the handle flap 80, and the ends of the bottom panel flaps 38 and 40 are also aligned. As previously noted, the top portions 17 of the end panel section 16 and the top portions 19 and 21 of end panel flaps 24 and 26 extend above the fold lines 42 and 44 at the top of the side panel sections 12 and 14. The end panels thus are designed to extend a distance above the tops of the side panels in a carrier formed from the blank.

To form a carrier, the center partition flap 72 is folded up about the fold line 74 and is adhered to the center partition 30 by glue applied to the stippled area 88 at the edge of the flap. The handle flap 80 is then folded down about the fold line 82 to adhere it to both the center partition 30 and the underside of the center partition flap 72 on the side opposite the stippled area 88. Glue applied to the stippled area 90 of the handle flap 80 adheres the handle flap to the center partition 30 and to the center partition flap 72. The blank 10 is then folded about fold line 28 to allow the glue flap 92 of the center partition flap 72 to be adhered to the end panel section 16 and the glue flaps 72 and 79 of the transverse partition flaps 76 and 78 to be adhered to the side panel section 12. The resulting interim blank configuration is shown in FIG. 2.

Figure 2:
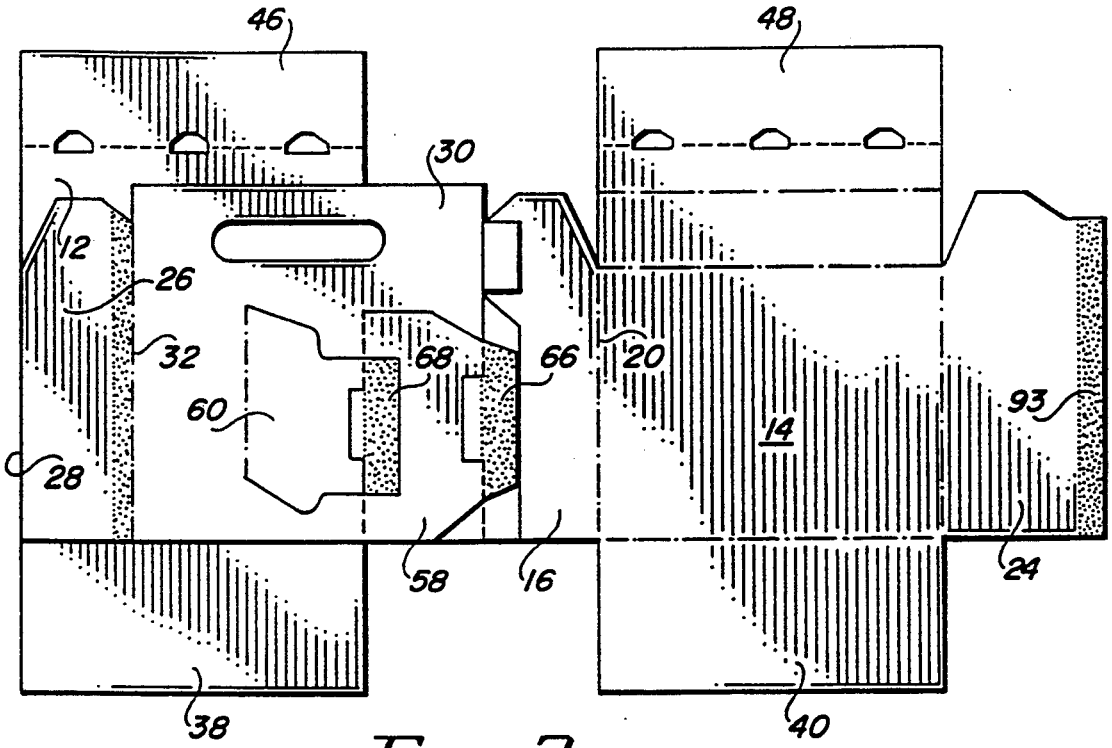
FIG. 2 is a plan view of the blank of FIG. 1 at an intermediate stage of carrier fabrication.
Figure 3:
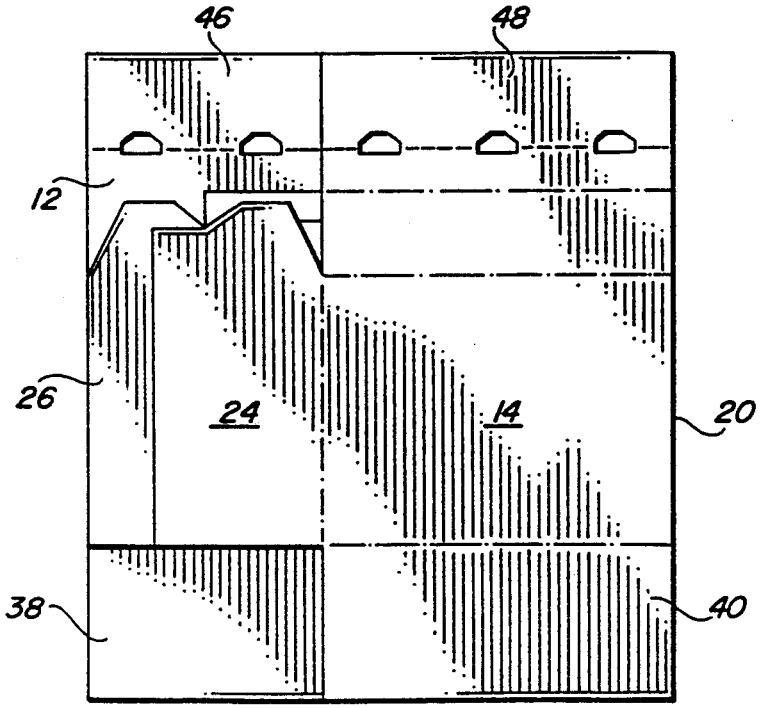
FIG. 3 is a plan view of the carrier blank of FIG. 1 in final collapsed form.

The next step is to fold the interim blank configuration of FIG. 2 about fold line 20, which adheres the end panel flap 24 to end panel flap 26 in the area contacted by the glue line 93, shown in stipple along the edge of end panel flap 24, and in the area shown in stipple on end panel flap 26. The glue flaps 66 and 68 will contact and be adhered to side panel section 14. This produces the collapsed sleeve form of the blank shown in FIG. 3, which is the form in which the blank is introduced to a packaging machine.

Figure 4:
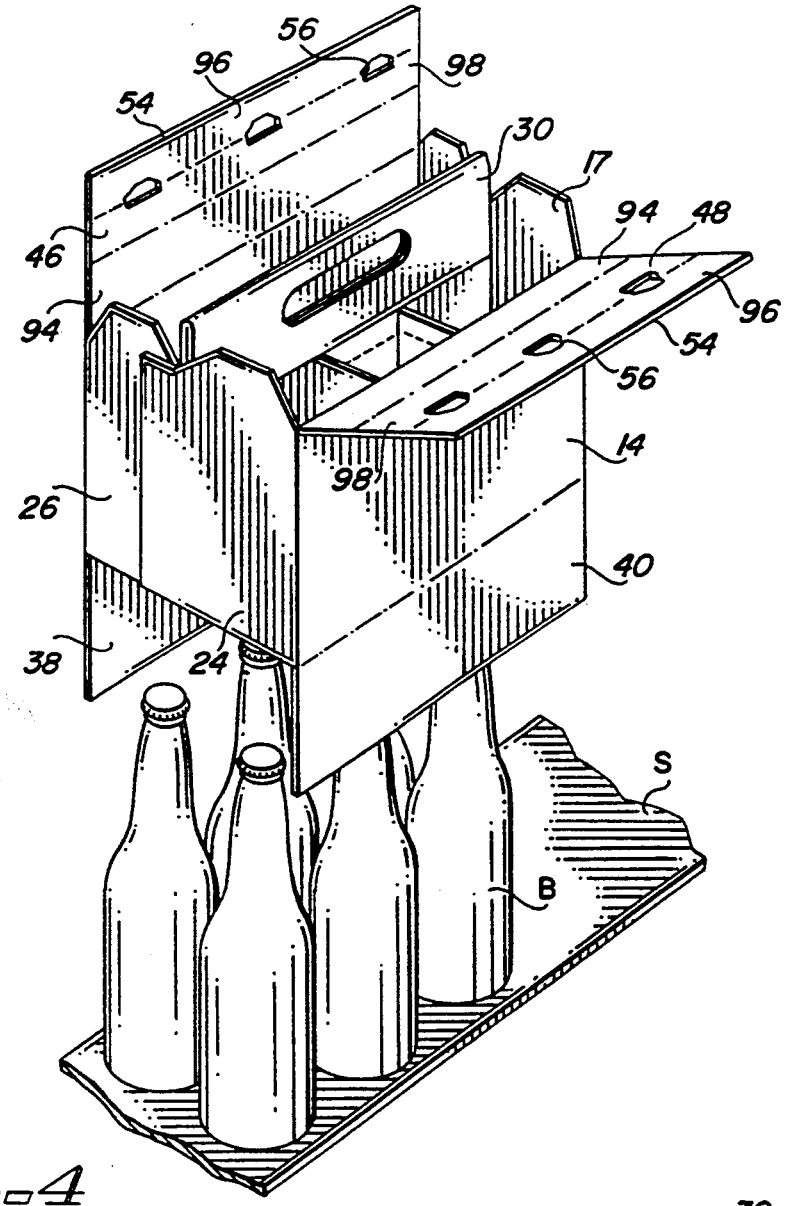
FIG. 4 is a pictorial view of the opened carrier blank just before being loaded with articles.

In the packaging machine, the collapsed sleeve is opened and squared up so that the open sleeve is positioned over the articles to be packaged. This is illustrated in FIG. 4, which shows the open sleeve positioned over six bottles B. Although the present invention is not concerned with the mechanism for forming the package in the packaging machine, those skilled in the art will understand that the bottles are on a moving support S and that the open sleeve will be lowered over the bottles while moving downstream at the same rate as the bottles. The bottom panel flaps will be folded under and adhered together, as by glue, which would be the case with the plain bottom flaps illustrated in the drawing, or by mechanical locking tabs, not shown. Each bottle is located in one of the cells formed by the center partition, the side and end panels, and the transverse partitions. The top panel flap nearest the viewer is shown in a slightly folded position in order to better reveal the cells in the carrier. In an actual packaging operation both top panel flaps would be extending substantially vertically in the manner of the farthest top panel flap shown in FIG. 4. The top panel flaps are then closed, with the openings 56 receiving the top portions of the bottles to hold the top panel flaps in place.

Figure 5:
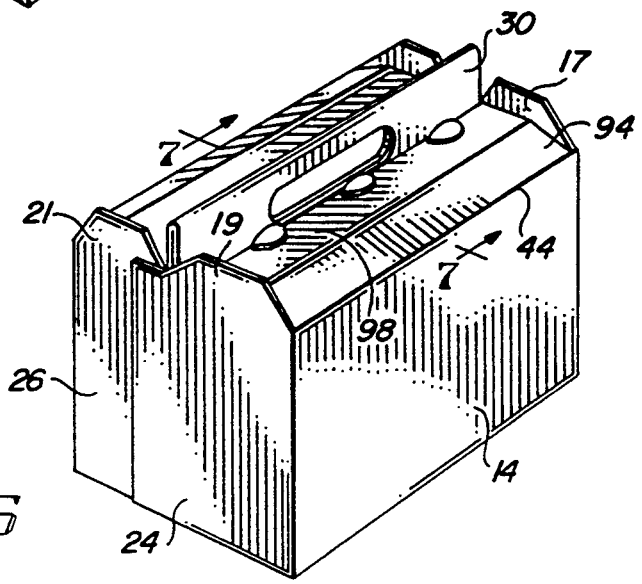
FIG. 5 is a pictorial view of the carrier of the invention.

Still referring to FIGS. 4 and 5, the top panel flaps when viewed from the ends are of generally arcuate transverse shape, formed by sloped portions 94 and 96 and intermediate flat portion 98. These portions are also shown in FIG. 1 as being formed by the areas between the top panel flap fold lines, wherein sloped portion 94 lies between fold line 52 and fold lines 42 and 44, sloped portion 96 lies between fold line 50 and the ends 54 of the top panel flaps, and intermediate flat portion 98 lies between the fold lines 50 and 52. The sloped portions 94 and 96 thus extend inwardly from the side panels of the carrier and connect with the intermediate flat portion 98. This results in the carrier shown in FIG. 5, wherein the ends of the top panel flaps 46 and 48 terminate at the center partition 30, leaving the handle formed from the openings 84 and 86 readily accessible. Note that the end panel extensions 17, 19 and 21 are shaped so as to cover the end edges of the top panel flaps, thereby protecting the contents of the carrier from light.

Figure 6:
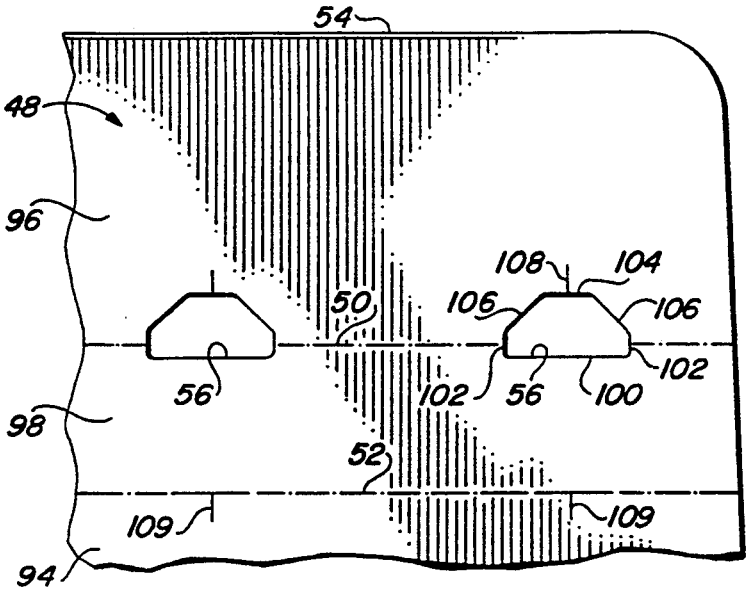
FIG. 6 is an enlarged partial plan view of the portion of top panel flap within the circle 6 of FIG. 1.

Referring now to FIG. 6, the openings 56 can be seen to comprise an elongated edge 100 in the intermediate section 98, two side edges 102 extending from the ends of edge 100 across the fold line 50, a short edge 104 in the sloped panel portion 96 parallel to the edge 100, and two angled edges 106 connecting the edges 100 and 104. A relief slit 108 may also be provided at the edge 104. Also, a T-shaped relief slit 109 is provided in section 94, with the crossbar of the slit being aligned with the fold line 52. In this arrangement the edge 104 comprises a locking edge adapted to engage the underside of a transverse or lateral projection of an article in the carrier. The T-shaped slit allows the top panel flaps to yield somewhat in the area opposite the openings 56 to facilitate moving the edge 104 into place.

Figure 7:
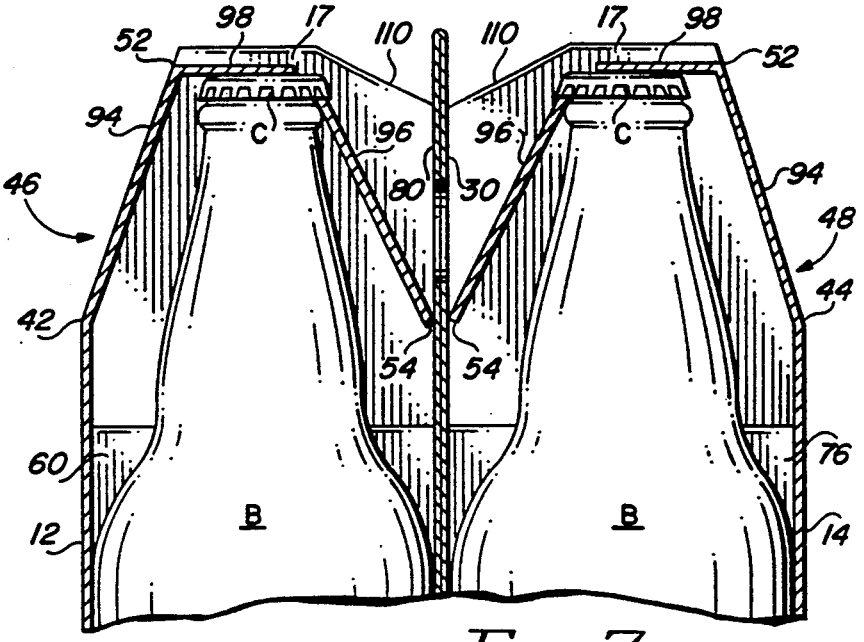
FIG. 7 is an enlarged partial transverse sectional view taken along line 7—7 of FIG. 5.
Figure 8:
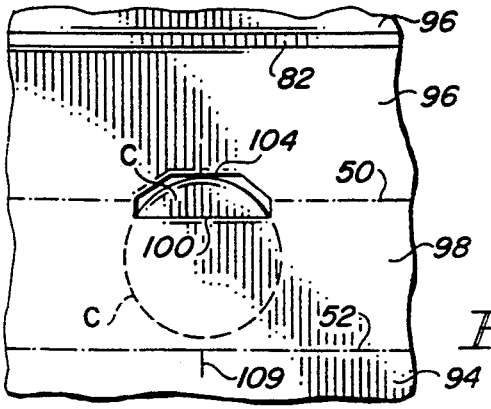
FIG. 8 is an enlarged partial plan view of one of the top flap openings of FIG. 7.

The locking arrangement of the top panel flaps is shown in more detail in FIGS. 7 and 8, wherein the locking edge 104 of the openings 56 can be seen to engage the underside of the cap C of bottle B, with the intermediate flap portion 98 contacting the tops of the bottle caps. The ends 54 of the top panel flaps are in contact with the center partition 30 to completely close the top panel against the entry of light. The flexible nature of the carrier material, which causes the folds to tend to return to their original flat condition, creates biasing forces that aid in maintaining the flaps in closed position. Thus the tendency of the folds 44 and 52 to straighten causes the locking edge 104 of the top panel flap 48 to be upwardly biased against the underside of the bottle cap C. Additionally, the tendency of the fold 50 to return to its original unfolded condition also biases the locking edge 104 against the cap. The biasing force produced by the folds also acts to maintain the end 54 of the flap in contact with the center partition. Thus the locking edge of the opening 56 should be located between the remote or free end 54 of a top panel flap and the nearest fold line 50.

The ends 54 of the flaps contact the center partition below the handle openings 84, 86 to allow access to the handle openings. If more room is required for the fingers of a user to enter the handle opening, the end flaps 96 can readily be pivoted inwardly by the fingers to provide additional access space.

As shown in FIG. 7, the end panel extensions 17 include sloping edges 110 which form a V-shaped outline. By thus reducing the height of the end panels adjacent the center partition, a user is easily able to note the location of the handle opening. The arrangement of the top panel flaps whereby the outer flap sections 96 extend below the handle opening also allows the opening to be seen and readily grasped.

Figure 9:
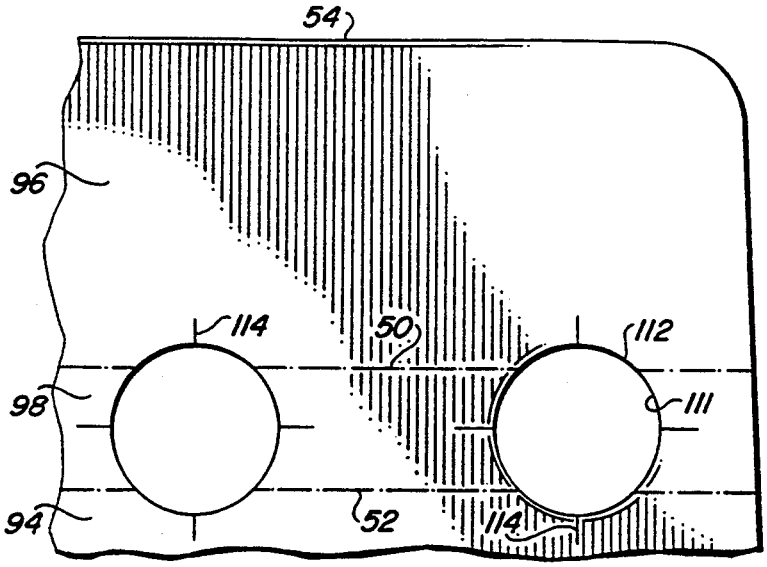
FIG. 9 is an enlarged partial plan view similar to the view of FIG. 6, but showing a modification thereof.
Figure 10:
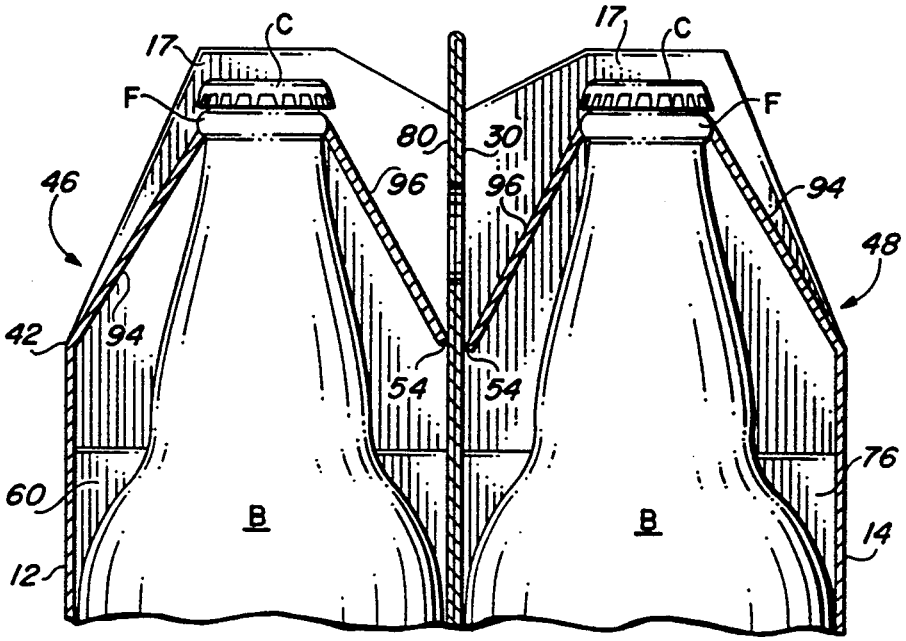
FIG. 10 is an enlarged partial longitudinal sectional view similar to the view of FIG. 7, but showing the modified top flap opening of FIG. 9 instead.
Figure 11:
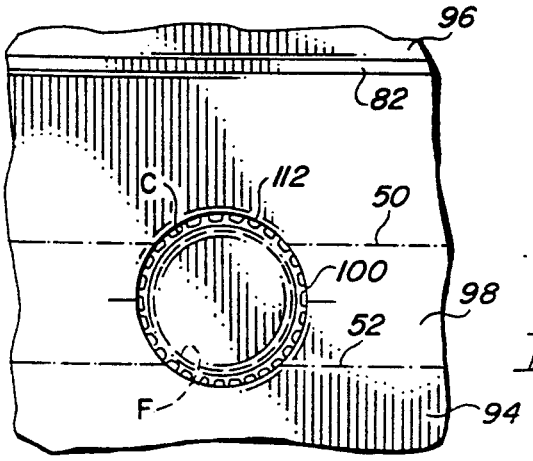
FIG. 11 is an enlarged partial plan view of the top flap opening of FIG. 9.

It is not essential that the locking openings in the top panel be limited to the shape shown in FIG. 6. The modified openings 111 of FIG. 9, for example, are circular and extend across the fold lines 50 and 52. The portion 112, representing the edge portion of the openings between the end fold line 50 and the end 54 of the flap 96, engages the underside of the flange or rim F of the bottles B beneath the cap C, as shown in FIGS. 10 and 11. The caps of the bottles thus are able to protrude through the openings, making it easier to move the top panel flaps down into place, while still providing the necessary locking engagement and protection against light. The upward biasing forces discussed in connection with the first embodiment also exist in this embodiment. Relief slits 114 facilitate movement of the top panel into place over the tops of the articles.

Figure 12:
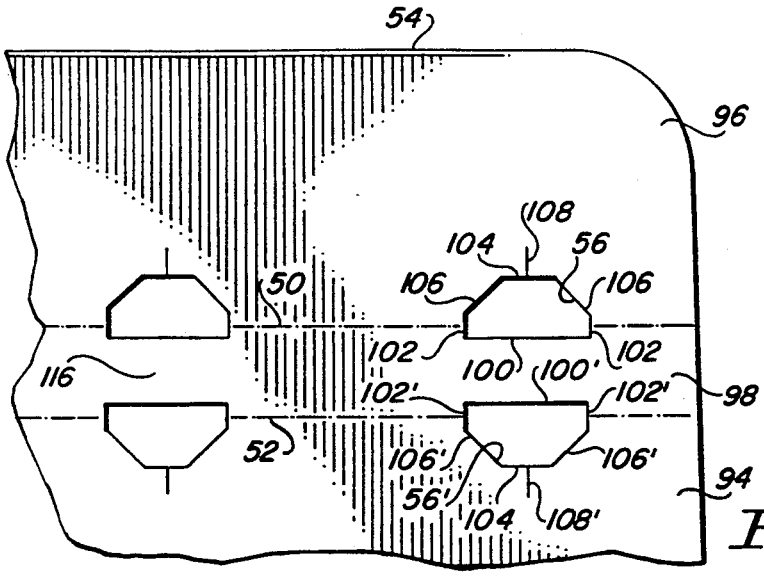
FIG. 12 is an enlarged partial plan view similar to the view of FIG. 6, but showing a further modification thereof.
Figure 13:
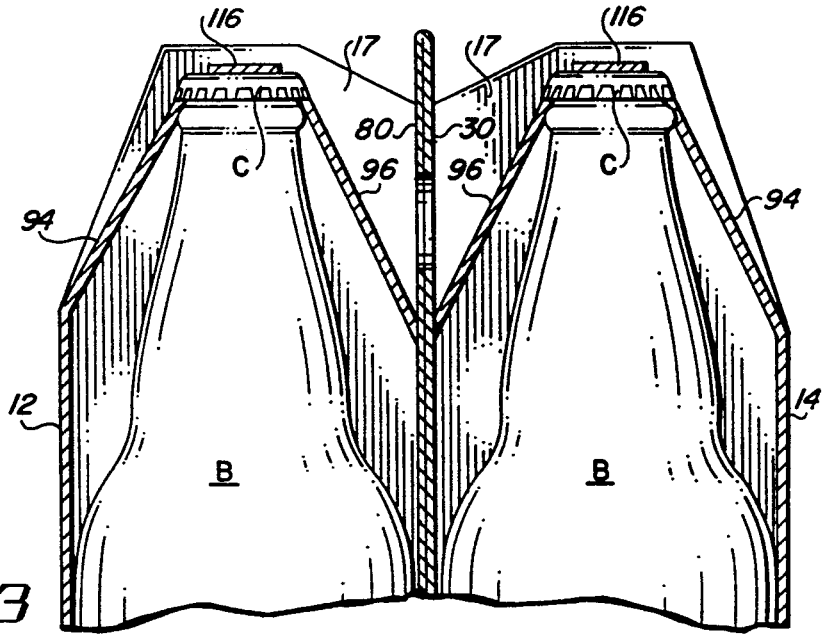
FIG. 13 is an enlarged partial longitudinal sectional view similar to the view of FIG. 7, but showing the modified top flap opening of FIG. 12 instead.
Figure 14:
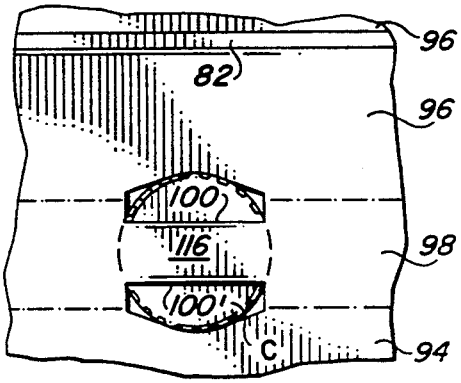
FIG. 14 is an enlarged partial plan view of the top flap opening of FIG. 12.

A further locking arrangement is shown in FIGS. 12–14. As illustrated in FIG. 12, the top panels are similar to those of FIG. 6 in that they include sloped end portions 94 and 96 and an intermediate portion 98. As in the blank of FIG. 6, the fold line 50 connecting sections 96 and 98 is interrupted by bottle top openings 56 having locking edges 104 located in the sloped top panel section 96 for engaging the underside of a bottle cap to assist in locking the top panel in place. In this arrangement, however, the fold line 52 is also interrupted by openings 56' which are identical to the openings 56 and are located opposite the openings 56. The locking edge 104' of an opening 56' is thus located in the sloped section 94 between the fold line 52 and the connection to the associated side panel.

In use, as illustrated in more detail in FIGS. 13 and 14, the locking edges 104 engage the underside of a bottle cap or other lateral projection on the side of the cap facing the handle, while the locking edges 104' engage the underside of a bottle cap or other lateral projection on the side of the cap facing its associated side panel. The locking edges 104' thus prevent forces acting in the opposite direction to the biasing force of the top panel flaps, such as forces resulting from case packing and palletizing operations, from causing the top panel to open. As shown in FIG. 14, the strap portion 116 of the intermediate top panel section 98 formed by the cutouts 56 and 56' overlies the top of a packaged bottle, assisting to hold the bottle in place.

It will be appreciated that the inclusion of locking openings in the top panel of the carrier does not allow light to contact the beverage in the bottles, since the portions of the bottles exposed to the light due to the presence of the openings is substantially limited to the bottle caps.

Figure 15:
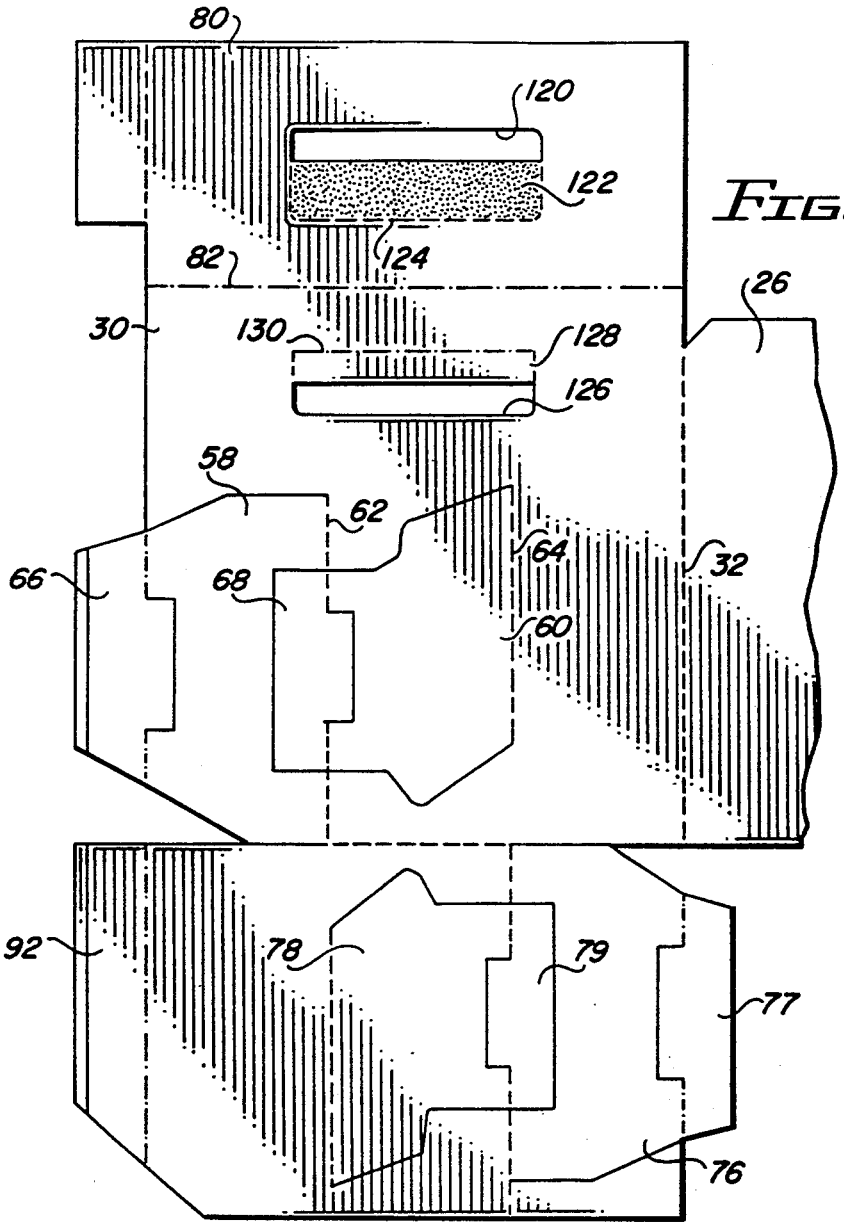
FIG. 15 is a partial plan view of a modified form of blank wherein an extra ply of blank material is provided in the handle.

A variation of the carrier blank which is designed to reinforce the handle area is shown in FIG. 15, wherein like reference numerals to those previously employed denote similar elements. Instead of the handle flap 80 containing a handle opening such as opening 86 in FIG. 1, it contains handle opening 120. A reinforcing tab or flap 122 hinged to the edge 124 of the opening closest to the fold line 82 partially covers the opening. The handle opening 126 in the center partition 30 includes a cushioning flap 128 which is hinged to the edge 130 of the opening nearest the fold line 82. The hinge or fold lines 124 and 130 are substantially equally spaced from the fold line 82.

Figure 16:
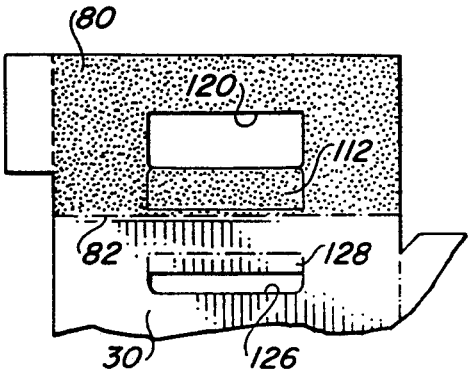
FIG. 16 is a partial plan view of the modified blank of FIG. 15 at an intermediate stage of fabrication.
Figure 17:
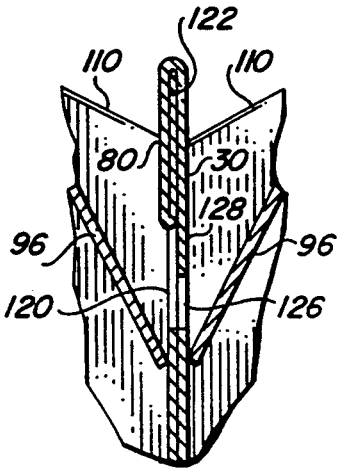
FIG. 17 is an enlarged partial transverse sectional view similar to that of FIG. 7, but showing the handle area after being formed from the blank of FIG. 15.

When forming a carrier from the blank of FIG. 15, adhesive is applied to the inner face of the reinforcing flap 122 as indicated by the stippling. The flap 122 is then folded down and adhered to the handle flap 80 as shown in FIG. 16. Adhesive is then applied to the handle flap 80, including the exposed face of the reinforcing flap 122 as illustrated by the stippling, and the handle flap is folded and adhered in the manner explained above in connection with the fabrication steps of the blank of FIG. 1. It can be seen from FIG. 16 that the reinforcing flap 122 will contact the portion of the center partition 30 between the handle opening 126 and the fold line 82. As illustrated in FIG. 17, the handle area of a carrier formed from the blank is thus comprised of layers 30, 122 and 80 to form a three-ply handle. The cushioning flap 128 extends partially down from the upper edge of the handle opening 126, in position to be folded back by the fingers of a person lifting the carrier. The handle openings 120 and 126 are aligned to form a single opening in the handle area of the center partition.

Figure 18:
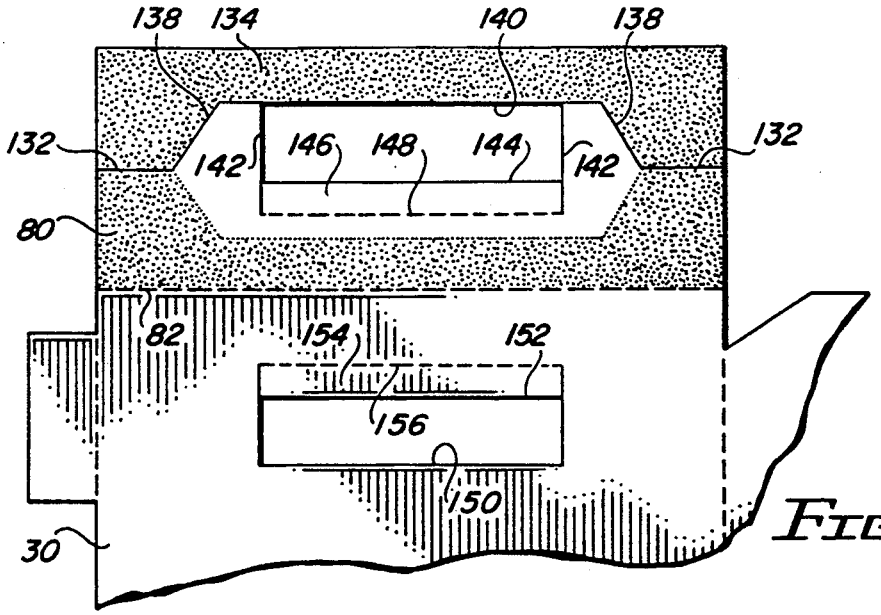
FIG. 18 is a partial plan view of another modified handle area of a blank which also provides an extra ply of material in the handle.
Figure 19:
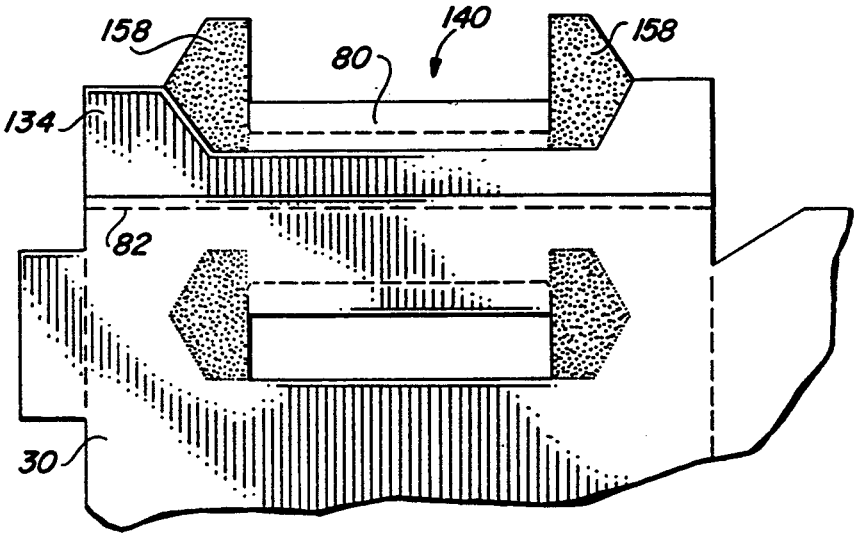
FIG. 19 is a partial plan view of the modified blank of FIG. 18 at an intermediate stage of fabrication.
Figure 20:
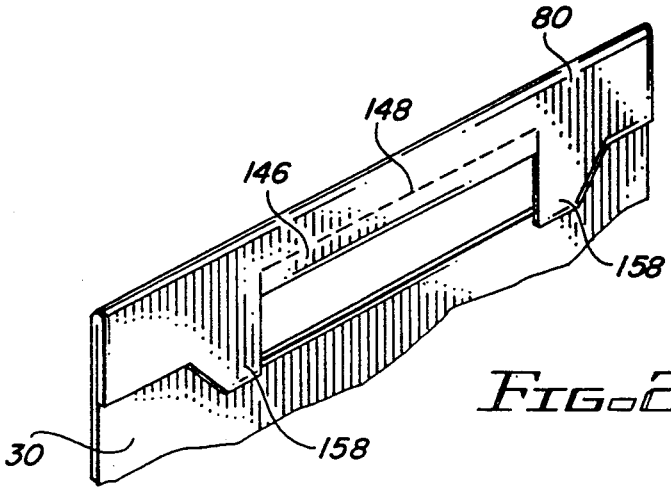
FIG. 20 is a pictorial view showing the handle of a carrier formed from the blank of FIG. 18.

Another modified handle designed to provide an additional reinforcing ply is illustrated in FIGS. 18–20. Referring first to FIG. 18, the handle flap 80 is connected along relatively short fold lines 132 to an outer flap 134. The inner ends of the fold lines 132 are connected by a continuous slit including a relatively long central slit portion 136 and two angled outer portions 138. An elongated handle opening 140 in the handle flap 80 is defined by a major portion of the slit 136, parallel edges 142 which are perpendicular to the slit 136, and edge 144 which is parallel to the slit 136. The edge 144 is comprised of the outer ends of tab 146, which is foldably connected to the handle flap 80, and the edge of a fold line 148 of the handle flap extending between the tab 146. The center partition 30 contains a handle opening 150 of substantially the same size and shape as the opening 140, including an edge 152 comprised of the outer ends of tab 154 and the edge of another fold line 156.

To form a handle from the handle flap and center partition, the outer flap 134 is folded about the fold lines 132 so as to be in face-to-face contact with the handle flap 80. The stippling on the outer flap 134 and on the handle flap 80 represents the surfaces brought into contact by this folding action, which also are surfaces that are adhered to each other by suitable glue. The resulting intermediate form of the blank illustrated in FIG. 19 shows that the folding of the outer flap 134 has resulted in the handle opening 140 becoming open-sided, with the portions of the handle flap 80 on either side of the edges 142 comprising projecting ears 158.

The final step in forming the handle requires the handle flap 80 to be folded about the fold line 82, resulting in the handle openings 140 and 150 becoming aligned. The areas contacted by the ears 158 and the center partition 30 are indicated by stippling, and represent the areas where the flaps are glued together.

The resulting handle formation is illustrated in FIG. 20. The handle strap formed by the overlying plies of the handle flap 80, the folded outer flap 134 and the center partition 30 provide triple thickness. The tab 146 is aligned with the tab 154, which would be visible from the opposite direction, and both are adapted to be folded under by a user to provide cushioning for the user's hand. The tabs 146 and 154 fold along their respective fold lines 148 and 156. Obviously, the number of tabs employed may vary according to the length of the handle opening, and they may be arranged so that all of them are foldably connected instead of only the tabs as shown.

Figure 21:
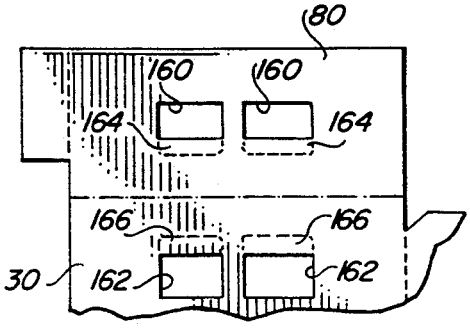
FIG. 21 is a partial plan view of another modified handle area of a blank.

Another variation of the handle is shown in FIG. 21, wherein the handle flap 80 contains two spaced handle openings 160 and the center partition contains two spaced openings 162. The openings are located so that upon folding the handle flap about the fold line 82 the handle openings 160 are aligned with the handle openings 162 to form handle openings in a two-ply handle. Cushioning tabs 164 and 166 are provided in the openings 160 and 162, respectively. Although this handle design does not include a reinforcing strip, it is stronger than a single hole design and reduces the risk of torque forces causing the handle to tear out.

It should now be clear that the invention provides for a novel carrier of the basket style which is completely enclosed by a top panel that is mechanically locked in place, and yet provides for easy access to the interior of the carrier. The carrier can be formed from a blank comprised of a single sheet of material dimensioned to require a minimum size blank. The carrier is well suited to packaging bottles of premium beverages which are desired to be packaged in cartons of high quality.

Although specific locking opening designs have been described, it will be understood that other designs which function similarly could also be employed. Further, it is contemplated that changes to other features and aspects of the invention which do not affect the overall basic function and concept of the invention may be made by those skilled in the art without departing from the spirit and scope of the invention, as defined by the appended claims.

What is claimed is:

1. An article carrier for carrying articles having a transversely extending projection in the top portion thereof, comprising:

two side panels connected to two end panels and to a bottom panel to form a carrier;

a center partition extending from one end panel to the other end panel, the center partition containing a handle opening therein;

a flexible top panel flap connected to each side panel; and each top panel flap having a fold line extending substantially parallel to the center partition and an opening adjacent the fold line for receiving a top portion of an article contained in the carrier;

the openings in the top panel flaps having a locking edge spaced from the fold line in the direction of the center partition, the locking edge being located so as to engage the transversely extending projection of an adjacent article in the carrier on the underside thereof.

2. The article carrier of claim 1, wherein each top panel flap has an unconnected end edge remote from the side panel to which the top panel flap is connected, the unconnected edge of each top panel flap being in contact with the center partition.

3. The article carrier of claim 2, wherein the top panel flaps have edges adjacent the end panels so as to substantially fully enclose articles contained in the carrier.

4. The article carrier of claim 2, wherein each top flap has a second fold line substantially parallel to the aforesaid fold line and spaced therefrom in a direction toward the side panel associated therewith, the area between the fold lines being substantially flat and parallel to the bottom panel.

5. The article carrier of claim 2, including at least one transverse partition extending from each side of the center partition toward the side panels to divide the interior of the carrier into article-receiving cells.

6. The article carrier of claim 2, wherein the unconnected end edges of the top panel flaps contact the center partition at a point below the handle opening.

7. The article carrier of claim 1, wherein the opening in each top panel flap extends toward the side panel associated therewith to an extent sufficient to receive the entire top portion of an article contained in the carrier.

8. The article carrier of claim 1, wherein each top flap has a second fold line substantially parallel to the aforesaid fold line and spaced therefrom in a direction toward the side panel associated therewith, each top panel flap having a second opening adjacent the second fold line, the second openings having a locking edge spaced from the second fold line in a direction toward the side panel associated therewith, the locking edge of each of the second openings being located so as to engage a portion of the transversely extending projection of an article engaged by one of the first mentioned openings.

9. A bottle carrier containing a plurality of bottles having a cap or other radially outwardly extending projection in the top portion thereof, comprising:

two side panels connected to two end panels and to a bottom panel to form a carrier;

a center partition extending from one end panel to the other end panel, the center partition containing a handle opening therein;

at least one bottle being on either side of the center partition;

a flexible top panel flap connected to each side panel; and each top panel flap having a fold line extending substantially parallel to the center partition and an opening adjacent the fold line through which a top portion of a bottle extends;

the opening having a locking edge spaced from the fold line in the direction of the center partition, the locking edge engaging a portion of the projection on the bottle on the underside thereof.

10. The bottle carrier of claim 9, wherein the carrier is comprised of paperboard and wherein each top panel has an unconnected end edge remote from the side panel to which the top panel is connected, the unconnected edge of each top panel flap being biased into contact with the center partition at a location lower than the tops of the bottles.

11. The bottle carrier of claim 10, wherein each top flap has a second fold line substantially parallel to the aforesaid fold line and spaced therefrom in a direction toward the side panel associated therewith, the area between the fold lines being substantially flat and parallel to the bottom panel.

12. The bottle carrier of claim 10, including at least one transverse partition extending from each side of the center partition toward the side panels to divide the interior of the carrier into article-receiving cells, each cell containing a bottle and the top panel flaps containing openings through which a portion of each bottle extends.

13. The bottle carrier of claim 9, wherein the opening in each top panel flap extends toward the side panel associated therewith to an extent sufficient to receive the entire top portion of the bottle associated therewith.

14. The bottle carrier of claim 9, wherein each top flap has a second fold line substantially parallel to the aforesaid fold line and spaced therefrom in a direction toward the side panel associated therewith, each top panel flap having a second opening adjacent the second fold line, the second openings having a locking edge spaced from the second fold line in a direction toward the side panel associated therewith, the locking edge of each of the second openings being located so as to engage a portion of the transversely extending projection of an article engaged by one of the first mentioned openings.

15. The bottle carrier of claim 9, wherein at least a portion of the center partition is comprised of two plies of material, with the handle opening extending through both plies, the area above the handle opening comprising a handle, the handle including a reinforcing strip between the two plies so as to form a three-ply handle.

16. The bottle carrier of claim 15, wherein the reinforcing strip is foldably connected to one of the plies of the center partition adjacent the handle opening therein.

17. The bottle carrier of claim 16, wherein one ply of material of the center partition is comprised of a center partition panel containing a handle opening and the other ply of material is comprised of a handle flap containing a handle opening, the handle flap being foldably connected to the center partition panel and being in folded condition in face-to-face contact with the center partition panel, the handle flap having an outer flap connected thereto along a fold line, the reinforcing strip being comprised of the outer flap in folded condition in face-to-face contact with the handle flap between the handle opening therein and the foldable connection between the handle flap and the center partition panel.

18. The bottle carrier of claim 17, wherein the fold line connecting the outer flap to the handle flap is interrupted by a slit, at least a portion of which slit is outwardly spaced from said fold line.

19. The bottle carrier of claim 18, wherein said outwardly spaced slit comprises an outward edge of the handle opening in the handle flap prior to the outer flap being folded into reinforcing position.

20. The bottle carrier of claim 18, wherein the outwardly spaced portion of said slit is connected to said fold line by slits extending transversely of said fold line, the handle opening in the handle flap being spaced from the transverse slits to form handle flap extensions, the handle flap extensions being adhered to the center partition panel.

21. A generally rectangular blank of flexible material for forming an article carrier for carrying articles having a transversely extending projection in the top portion thereof, comprising:

an interior end panel section connected along opposite fold lines to two side panel sections;

a first end panel flap connected to one of the side panel sections along a fold line and a second end panel flap connected to the other side panel section along a fold line, the end panel flaps being adapted to be connected to form an end panel of the carrier;

a bottom panel flap connected along a fold line to each of the side panel sections;

a center partition connected along a fold line to one of the end panel flaps, the center partition adapted to extend from one end panel to the other end panel of a carrier formed from the blank;

a top panel flap connected to each side panel section along a fold line opposite the bottom panel flap connected to said side panel section;

each top panel flap having an unconnected end remote from the associated side panel section; and each top panel flap having an interior fold line extending substantially parallel to the fold line connecting the top panel flap to the associated side panel section and an opening adjacent the interior fold line for receiving a top portion of an article contained in the carrier formed from the blank;

the opening having a locking edge spaced from the interior fold line in the direction away from the associated side panel, the locking edge being located so as to engage the transversely extending projection of an article in the carrier formed from the blank on the underside thereof.

22. The article carrier blank of claim 21, wherein each top panel flap extends from the associated side panel section a distance sufficient to cause the unconnected edge of each top panel flap to be in contact with the center partition of the carrier formed from the blank.

23. The article carrier blank of claim 22, wherein the end panel section and the end panel flaps are dimensioned to be adjacent the ends of the top panel flaps in the carrier formed from the blank.

24. The article carrier blank of claim 22, wherein each top flap has a second fold line substantially parallel to the interior fold line and spaced therefrom in a direction toward the side panel associated therewith, the area between the fold lines adapted to form a top panel section in the carrier formed from the blank which is substantially parallel to the bottom panel of the carrier.

25. The article carrier blank of claim 22, including a center partition flap connected to the center partition along a fold line, both the center partition and the center partition flap having at least one transverse partition connected thereto along a fold line, the transverse partitions being adapted to be connected to the side panels of the carrier formed from the blank to divide the interior of the carrier into article-receiving cells.

26. The article carrier blank of claim 21, wherein each top flap has a second interior fold line substantially parallel to the aforesaid interior fold line and spaced therefrom in a direction toward the side panel section associated therewith, each top panel flap having a second opening adjacent the second interior fold line, the second opening having a locking edge spaced from the second interior fold line in a direction toward the side panel section associated therewith, the locking edge of the second opening being located so as to engage a portion of the transversely extending projection of an article engaged by one of the first mentioned openings in a carrier formed from the blank.

27. The article carrier blank of claim 21, including a handle flap connected to the center partition along a fold line, the handle flap and the center partition containing handle openings which are aligned when the handle flap is folded against the center partition about said fold line, the handle flap or the center partition including a reinforcing flap foldably connected to the opening therein so as to be capable of folding down between said opening and said fold line to form a reinforcing strip in the handle of a carrier formed from the blank.

28. The article carrier blank of claim 27, wherein the handle flap includes an outer reinforcing flap connected thereto along a fold line interrupted by a slit, at least a portion of the slit being outwardly spaced from said fold line.

29. An article carrier, comprising:

two side panels connected to two end panels and to a bottom panel to form a carrier;

a center partition extending from one end panel to the other end panel, the center partition containing a handle opening therein;

the center partition being comprised of a center partition panel containing a handle opening and a handle flap containing a handle opening, the handle flap being foldably connected to the center partition panel and being in folded condition in face-to-face contact with the center partition panel, the handle flap having an outer reinforcing flap connected thereto along a fold line, said fold line being interrupted by a slit, at least a portion of said slit being outwardly spaced from said fold line, the outer reinforcing flap being in folded condition in face-to-face contact with the handle flap between the handle opening therein and the foldable connection between the handle flap and the center partition panel, whereby the handle includes three plies of material.

30. The article carrier of claim 29, wherein said outwardly spaced slit comprises an outward edge of the handle opening in the handle flap prior to the outer flap being folded into reinforcing position.

31. The article carrier of claim 30, wherein the outwardly spaced portion of said slit is connected to said fold line by slits extending transversely of said fold line, the handle opening in the handle flap being spaced from the transverse slits to form handle flap extensions, the handle flap extensions being adhered to the center partition panel.

* * * * *